United States Patent [19]

Asao et al.

[11] Patent Number: 4,854,252

[45] Date of Patent: Aug. 8, 1989

[54] METHOD FOR BUTTON SEWING

[75] Inventors: Hideo Asao, Mitaka; Satoru Yamazi; Seiichi Saibe, both of Kashihara, all of Japan

[73] Assignees: Juki Corporation; Takatori Machinery Manufacturing Co., Ltd., both of Tokyo, Japan

[21] Appl. No.: 193,333

[22] Filed: May 12, 1988

[30] Foreign Application Priority Data

May 11, 1987 [JP] Japan ..... 62-115492

[51] Int. Cl.[4] ..... D05B 97/02; D05B 3/14

[52] U.S. Cl. ..... 112/265.1; 112/112; 112/113; 112/171

[58] Field of Search ..... 112/112, 110, 113, 171, 112/265.1

[56] References Cited

U.S. PATENT DOCUMENTS 3,140,679 7/1964 Pederson ..... 112/110
3,182,618 5/1965 Pedersen ..... 112/110
3,329,111 7/1967 Pedersen et al. ..... 112/110
4,134,350 1/1979 Dancsó et al. ..... 112/110
4,712,493 12/1987 Aso et al. ..... 112/112

*Primary Examiner*—H. Hampton Hunter
*Attorney, Agent, or Firm*—Morgan & Finnegan

[57] ABSTRACT

A button sewing apparatus comprising a button supply device, a X–Y mover, a stay button chucking device, a surface button chucking device, a surface button turning device, a presser foot device, a thread guiding device and a thread holding device. Button neck wrapping is performed in a manner closely simulating "hand" sewing. After sewing both a stay button and a surface button to a workpiece, a sewing table makes a circular motion while keeping a needle entry as the center, and a thread is slidably clamped and guided to pass through a guide hole tentatively formed underneath a needle such that the thread wraps firmly around the button neck.

1 Claim, 12 Drawing Sheets

METHOD FOR BUTTON SEWING

BACKGROUND OF THE INVENTION

This invention relates to sewing devices and more particularly to a method and an apparatus for button sewing.

Japanese utility model No. 45-13643 describes the background of the present invention. According to this publication, after sewing the button on to the horizontal workpiece, the button is turned vertically and the workpiece is moved horizontally per each needle's one up-down motion such that the thread wraps around the button neck portion to perform "button-neck-wrapping".

The present invention addresses a problem which arises when a stay button and a surface button are sewed to a thick workpiece like a coat material or a knitted material. It is impossible to simultaneously sew both a stay button and a surface button by placing the surface button at upper side of the material and the stay button at lower the side of the material, and then conduct button-neck-wrapping after finishing button sewing. According to the conventional way of button-neck-wrapping, after the button is sewn, the button is turned vertically and the button is moved horizontally when the needle performs one reciprocal motion such that the needle drops both sides of sewn thread. The manual way of button-neck-wrapping, compares favorably with the conventional apparatus because, manual results in a more uniform and of a higher sewing quality end produce.

The present invention provides a solution comprising an upper-needle-bar and a lower-needle-bar which are aligned vertically and conduct up-down motion in association with the drive motor, the driving device which drives the workpiece and the button in the X–Y direction. The needle with the eyed thread having definite length for sewing is arranged to travel between the upper-needle-bar-spindle and the lower-needle-bar-spindle and is received alternately per each needle stroke such that buttons are sewn in a manner closely simulating "hand" sewing. After sewing the button, the button is upturned from the needle's vertical pass-way, and received in the lower-needle-bar-spindle so that it penetrates upward into the workpiece. After the needle is received in the upper-needle-bar-spindle, the button is turned down to resume the original position. The thread is then pulled and guided into a position just under the needle point. The surface button is then released from the clamping jaw but its bottom portion is supported by the bifurcated holder, and then the driving device performs "button-neck-wrapping" by driving the workpiece in a circular and horizontal motion around the thread guide positioned just under the needle point.

SUMMARY OF THE INVENTION

It is the object of the present invention to provide a button sewing machine wherein both upper-needle-bar and lower-needle-bar are aligned vertically and reciprocate vertically in association with the drive motor, and the driving device drives the workpiece and the button in direction of X–Y, and a needle with an eyed thread having definite length for button sewing is arranged to travel between the upper-needle-bar spindle and the lower-needle-bar spindle. In this manner, the lower-needle-bar spindle is received alternately with each needle stroke such that buttons are sewn in a manner closely simulating "hand" sewing. The button sewing machine may also accommodate movement of the workpiece one button-hole-pitch as the needle conducts one up-down motion. These and other objects of the invention will be more fully described in the detailed description.

According to the present invention, after, a stay button and a surface button are sewn, Button-neck-wrapping is automatically conducted by pressing the thread between a lower clamper and an upper clamper and guiding the thread T into a position just under the needle N. The workpiece travels in a circular motion with the needle drop point as center, while the surface button is released. In this manner, the thread is wrapped as if it were sewn by hand from the lower side to the upper side. The pulling of the thread on an angle upwardly causes a greater tension on the lower portion of the sewn thread.

BRIEF DESCRIPTION OF THE DRAWINGS

The accompanying drawings, referred to herein and consisting a part hereof, illustrate a preferred embodiment of the invention and, together with the descriptions, serve to explain the principles of the invention, wherein.

DETAILED DESCRIPTION OF THE DRAWINGS

Figure 1:
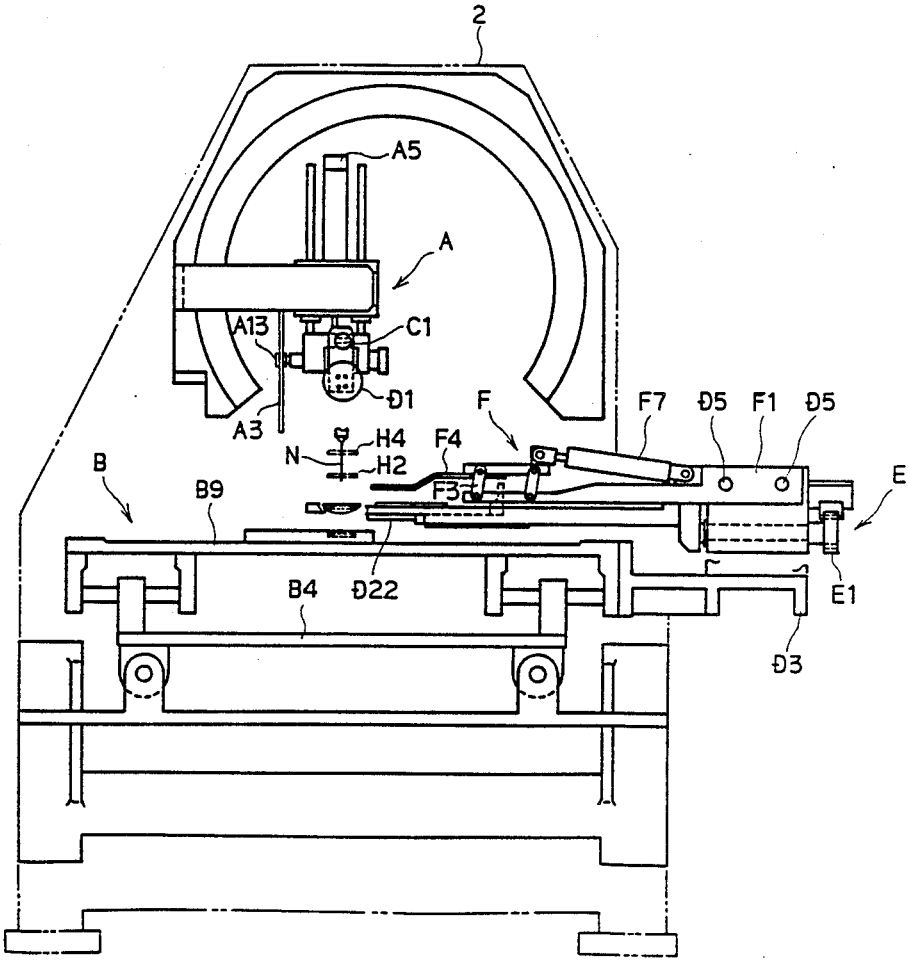
FIG. 1 is a front view drawing of a button sewing machine according to this invention.
Figure 2:
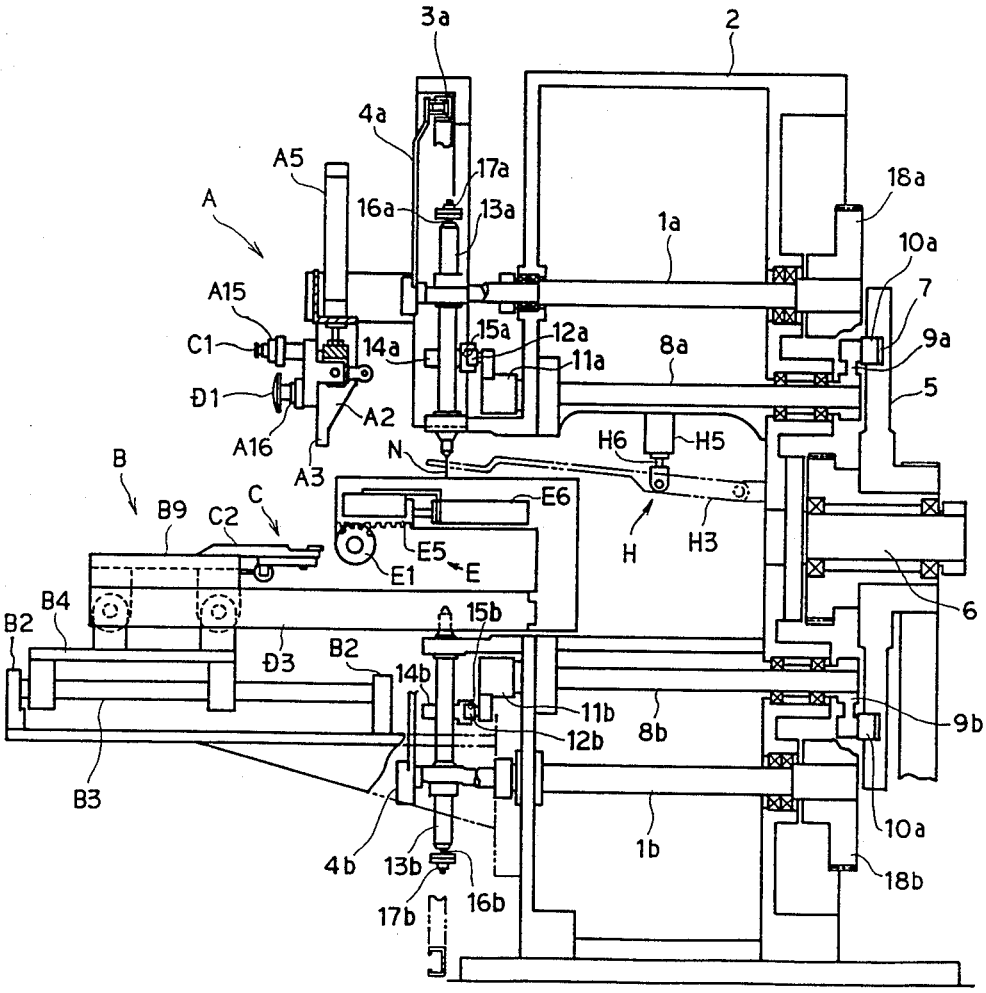
FIG. 2 is a side view of FIG. 1.
Figure 3:
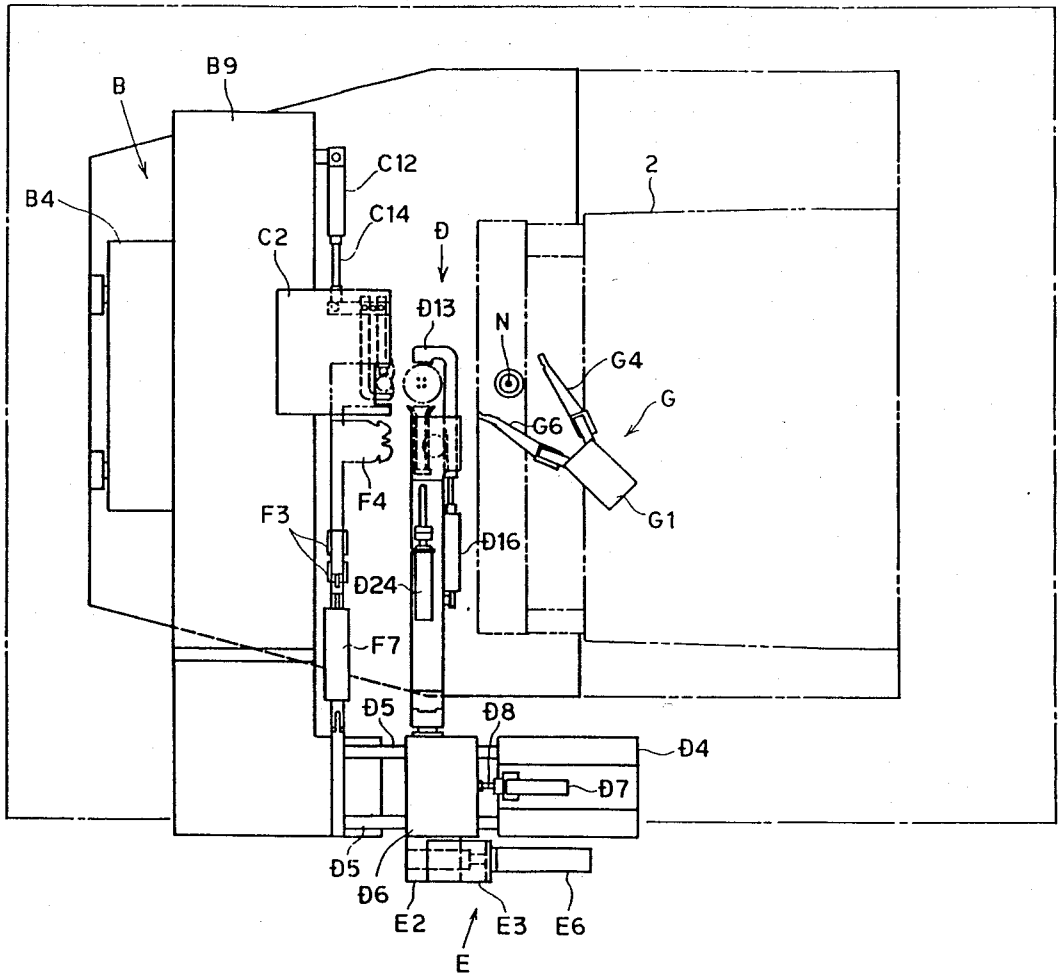
FIG. 3 is a partial plan view of FIG. 1.

The present invention relates to a unique apparatus and method for button sewing as shown in the accompanying drawings. FIG. 1, FIG. 2, and FIG. 3 illustrate the mechanism for up-down motion of both upper-needle-bar and the lower-needle-bar, the button supplying device, the X–Y mover which drives both workpiece and button in direction of X–Y. FIG. 1 is a front view drawing, FIG. 2 is a side view drawing, FIG. 3 is a plan view drawing. Due to the symmetry of position and function of up-down motion of both upper-needle-bar and lower-needle-bar an, "a" is appended to each numeral pertaining to the upper-needle-bar and upper looper, and a "b" to identify those numerals pertaining to lower-needle-bar and lower looper.

Referring, first, to FIG. 2, an upper looper shaft (1*a*) is rotatably sustained by a frame 2. At left end of the upper looper shaft l*a*, looper (4*a*) is fixed. Numeral (3*a*) is a looper thread guide. A disc like cam (5) is fixed to the right end of a drive shaft (6). A cam groove (7) provided at the surface of the cam (5) causes both upper-needle-bar and the lower-needle-bar to reciprocate vertically. An upper-needle-bar-drive-shaft (8*a*) is sustained rotatably by the frame (2). Cam-arm (9*a*) by its base portion is fixed to the upper-needle-bar-drive-shaft (8*a*) and by its tip end is fixed to a roller (10*a*) which is slidably inserted into the cam groove (7). A crank-arm for the upper-needle-bar (11*a*) by its base portion is fixed to the left end of the upper-needle-bar-drive-shaft (8*a*) and by its tip end is rotatably inserted into the slide block (12*a*). Upper-needle-bar 13(*a*) is sustained by the frame and conducts the up-down motion. A needle-bar-connector (14*a*) by its base portion is fixed to the upper-needle-bar (13*a*) and by another end forms a channel groove (15*a*) in which the slide block (12*a*) is slidably inserted. A chuck bar (16*a*) has an upper end provides an adjustable screw (17*a*) such that the end of the adjustable screw (17*a*) causes the needle N to be released from an upper-needle-bar chucking device when the upper-needle-bar (13*a*) descends and the adjustable screw (17*a*) touches a metal bushing located at the frame (2). Accordingly, the needle N released from the upper-needle-bar (13*a*) is transferred to a lower-needle-bar (13*b*).

Thus, when the needle N received in the upper needle bar (13*a*) descends and penetrates down the workpiece, the lower-needle-bar (13*b*) receives the needle N, chucks and descends, thereby causing the needle N to penetrate through the workpiece. Then, as the lower-needle-bar (13*b*) ascends, the needle N penetrates up the workpiece and is received in the upper-needle-bar and simultaneously the chucking device of lower-needle-bar is released such that the needle N penetrates through the workpiece.

The upper-looper-shaft (1*a*) engages a gear wheel (18*a*) at its right end, and conducts rotary motion in association with the rotation of the drive shaft (6) via a eccentric gear wheel (not shown). Thus the upper looper shaft (1*a*) rotates but its rotation speed is not uniform. As the upper looper (4*a*) rotates non-uniformly it exerts an upward pull on the thread which traversed through the workpiece by upward penetration of the needle (N). The lower looper (4*b*), likewise, rotates non-uniformly and pulls the thread downwardly.

Figure 4:
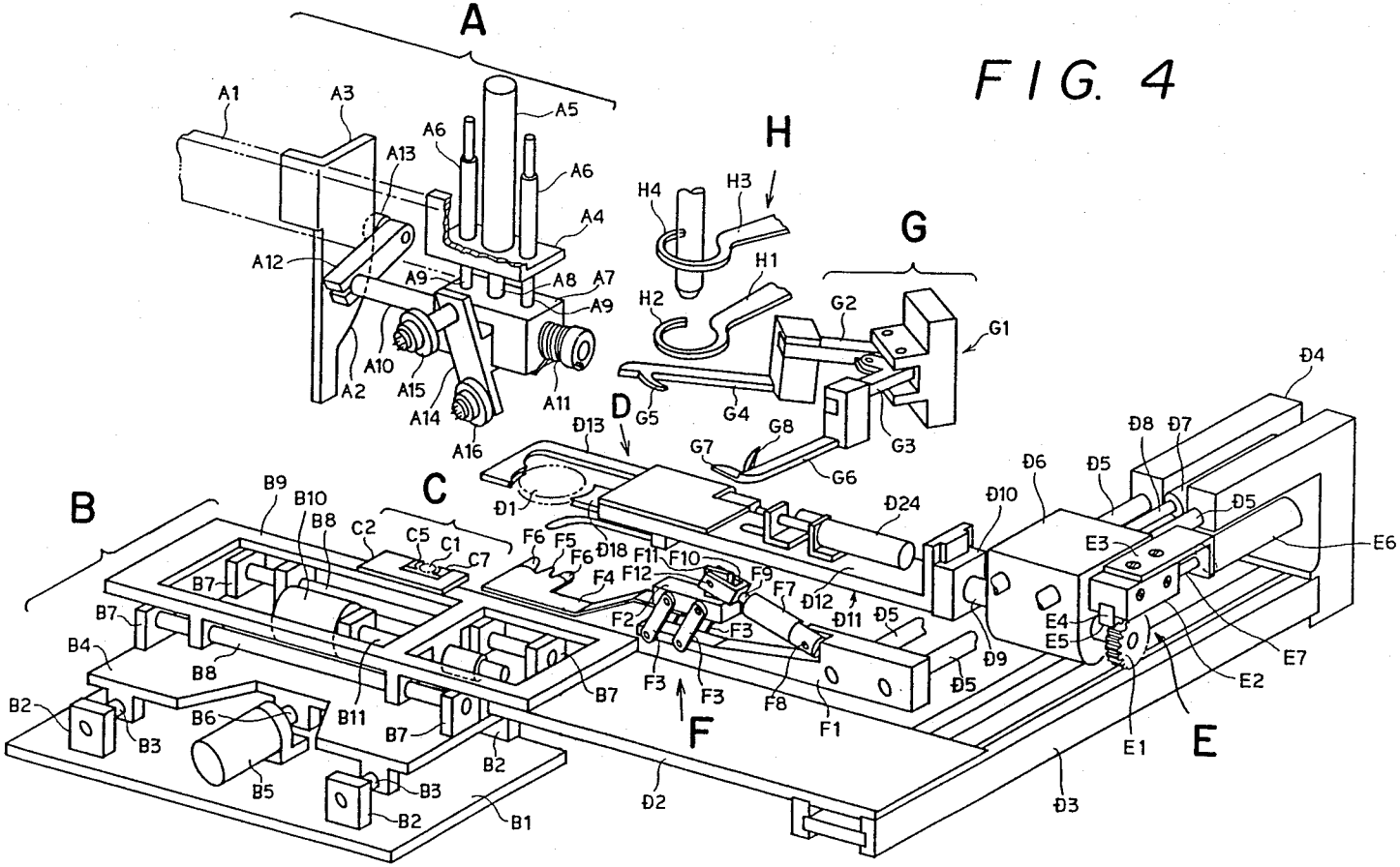
FIG. 4 is a perspective view explaining a button supply device A, a X–Y mover B, a stay button chucking device C, a surface button chucking device D, a surface button turning device E, a presser footing device F, a thread guiding device G, a thread holding device H.

FIG. 4 illustrates a button supply device (A) which transfers buttons to chucking device. Support plate (A1) affixed to frame (2), affixes a cam plate (A3) with a cam surface (A2), and an L-shaped supporting body (A4). Affixed to the supporting body (A4) is a cylinder (A5) at its center and two tube-like bearings (A6) on alternate sides of the cylinder (A5).

To the upper surface of a block body (A1) is connected a rod-like continuation (A8) of the cylinder (A5), and two guide posts (A9), slidably inserted into the bearing (A6). A rotary shaft (A10) is rotatably sustained at the block body (A7) and is urged to rotate clockwise by a spring (A11). An arm (A12) is fixed at the end of the rotary shaft (A10) with a roller (A13) at its end.

The roller (A13) is urged in contact with the cam surface (12) by the spring (A11). A button holder (A14) and its base portion is fixed to the rotary shaft (A10), and provides a stay button holder (A15) and a surface button holder (A16). The stay button holder (A15) is extended farther than the surface button holder (A16) from the surface of the button holder (A14). With the stay button holder (A15) and the rotary button holder (A16) positioned as shown in FIG. 4, a stay button (C1) is attached to the stay button holder (A15) and a surface button (D1) is attached to the surface button holder (A16). After setting the buttons, cylinder (A5) expands and rod (A8) descends, the block body (A7) descends, and roller (A13) rolls downwards along the cam surface (A2) while the rotary shaft (A10) rotates counter clockwise and the button holder (A14) positions itself and buttons (C1) and (D1) horizontally at the predetermined position. Then cylinder (A5) contracts and rod (A5) ascends taking button holder (A14) to its original, home position as shown in FIG. 4.

FIG. 4 illustrates movement in the X–Y directions by the X–Y mover. A support plate (B1) fixed to the frame (2) supports and affixes four bearings B2 which sustain two paralleled Y-direction shafts B3. B4, a Y-mover, has a bottom which is slidably sustained by two Y-direction shafts (B3). A pulse motor (B5) fixed on the support plate (B1) drives the support plate (B1) in Y-direction as a screwed-feed-shaft (B6) engages with the support plate (B1). X-mover (B9) is bottom and slidably mounted on two X-direction shafts (B8). The two X-direction shaft (B8) are in turn sustained by four bearings (B7). Movement of the X-mover (B9) in the X-direction is by a pulse motor (B10) in conjunction with a screwed-feed-shaft (B11) which engages with the X-mover (B9). Thus the pulse motors (B5) and (B10), provide power to move the X-mover (B9) in the X–Y direction.

Figure 5:
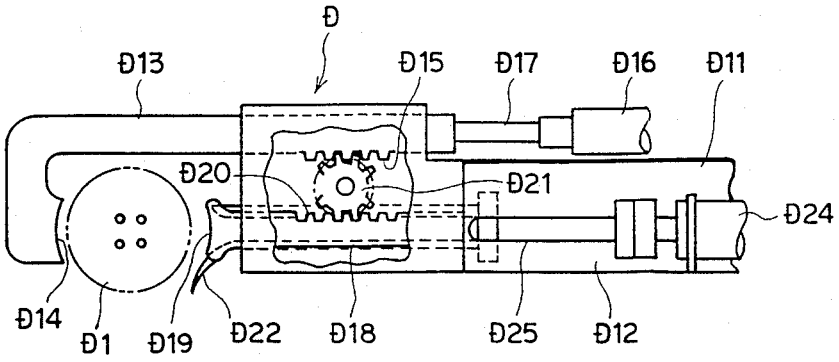
FIG. 5 is a partial plan view drawing of a surface button chucking device D.
Figure 6:
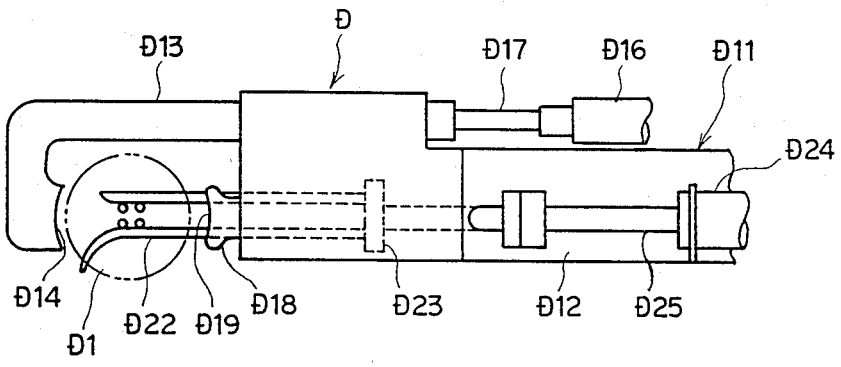
FIG. 6 is a partial plan view drawing of a surface button chucking device D where a bifurcated-button holder is extended under a surface button.
Figure 7:
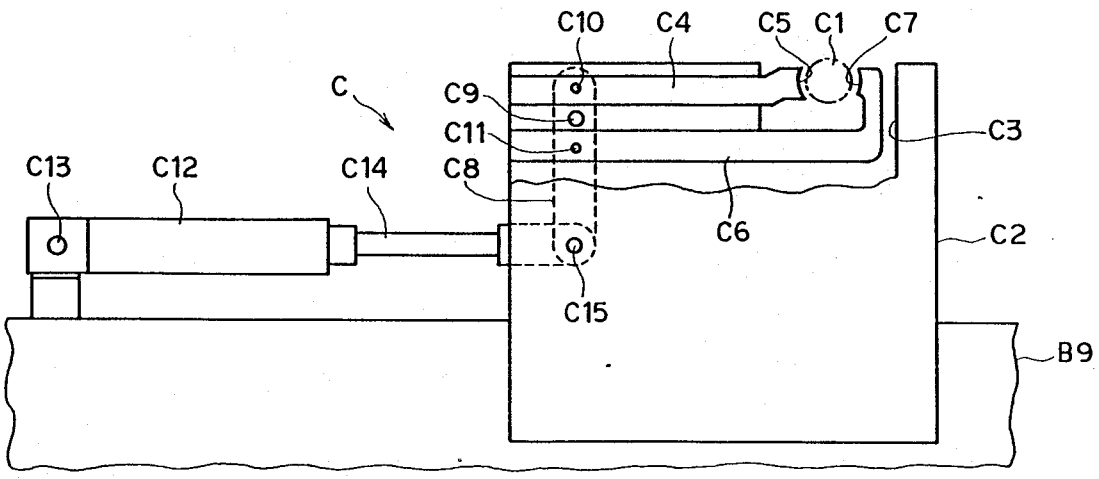
FIG. 7 is a plan view drawing of a stay button chucking device C.

A stay-button chucking device C is shown in FIG. 7 having a support plate (C2), fixed to the X-mover (B9) and provided with a recess (C3). A left jaw (C4) is slidably inserted in the groove and provided with a curved jaw (C5) to clamp a stay button (C1). A right jaw (C6) slidably inserted in the groove is provided with a curved jaw (C7) such that the curved jaw (C7) faces with the left curved jaw (C5). A rotary link (C8) is rotatably supported by a shaft (C9) and is pivoted to both left jaw (C4) and right jaw (C7) by pin (C10) and (C11) respectively. Cylinder (C12) and its base portion is pivoted to the X-mover (B9) by a pin (C13), and the end of a rod (C14) is pivoted to the rotary link (C8) by a pin (C15). When the rod (C14) contracts, the rotary link (C8) rotates clockwise causing movement of the left curved jaw (C5) to the right and movement of the right curved jaw (C7) to the left, clamping the stay button (C1). Surface button chucking device (D) is shown in FIG. 4, FIG. 5 and FIG. 6. The connecting plate (D2) as shown in FIG. 4 is affixed at its left end to the X-mover (B9) and at its right end to an H-shaped support body D3 which extends in the Y-direction.

An L-shaped support angle (D4) is affixed at its bottom to the end of the support body (D3). Another end of the support angle (D4) fixes two paralleled guide shafts (D5). Slidably supported by the two guide shafts D5 is a slider, (D6). A rod (D8) extending out of cylinder (D7) is affixed to support angle (D4) and connected to the slider (D6) such that the slider (D6) is moved in the Y-direction by the cylinder (D7) along the guide shaft (D5). A rotary shaft D9 is rotatably sustained at the slider (D6) and provides a holder (D10) at its left end. A support plate (D11) is fixed to the holder (D10) and provides a flat surface.

FIG. 5 shows a left surface button jaw (D13) slidably inserted in a groove on the flat surface (D12), and provides a curved jaw (D14) at its left end forming a rack portion (D15) at its middle-inside portion. Right end of the left surface button jaw (D13) is connected to a rod (D17) of a cylinder (D16) fixed to the flat surface (D12). Symbol (D18) denotes a right surface button jaw slidably inserted in a groove provided on a flat surface (D12), and provided with a curved jaw (D19) at its left. Rack portion (D20) is formed at the inner middle portion of (D18). These rack portions (D15) and (D20) mesh with a gear (D21) which is pivoted on the flat surface (D12). When the cylinder (D16) draws a rod (D17), the left curved jaw (D14) moves rightwards and the right curved jaw (D19) moves leftwards by the rotation of the gear (D21). Thus the surface button (D1) is clamped by these curved jaws.

A bifurcated-button-holder D22 shown in FIG. 6 and its end is fixed to a support (D23) which is located on the bottom side of the flat surface (D12). The support (D23) has a projection (not shown) which projects above the flat surface (D12) through a oblong hold (not shown) provided on the flat surface (D12). The projected portion of the supported (D23) is fixed to a rod (D25) of a cylinder (D24). When the cylinder (D24) expands, the bifurcated-button-holder (D22) is positioned just under the surface button D1 such that the sewn button D1 is clamped by the bifurcated button holder (D22).

Surface-button-turning-device (E) is showing in FIG. 4. Gear (E1) is fixed to the right end of the rotary shaft (D9). A rack support (E2) is fixed to the side wall of the slider (D6) and its top-side fixes the base portion of the cylinder supporter (E3). A rack body (E4) is slidably inserted into the rack support (E2). The rack body (E4) provides a rack (E5) at its lower portion, and the rack (E5) meshes with the gear (E1). A cylinder (E6) is fixed to the cylinder supporter (E3) and its rod (E7) is connected to the rack body (E4). When the cylinder (E6) expands, the rod (E7) pushes the rack body (E4), and the rack body (E4) slides, so that the gear (E1) rotates while the rotary shaft (D9) rotates counter clockwise such that the support plate (D11) is rotated counter clockwise.

Presser device (F) is shown in FIG. 4. Support (F1) is fixed by its base portion to the end of the guide shaft (D5). A mover (F2) is supported at the upper end of the support (F1) by four links (F3). A presser foot F4 is fixed by its base portion to the bottom of the mover (F2). The presser foot (F4) comprises one center presser (F5) and two outer presser (F6).

Figure 9:
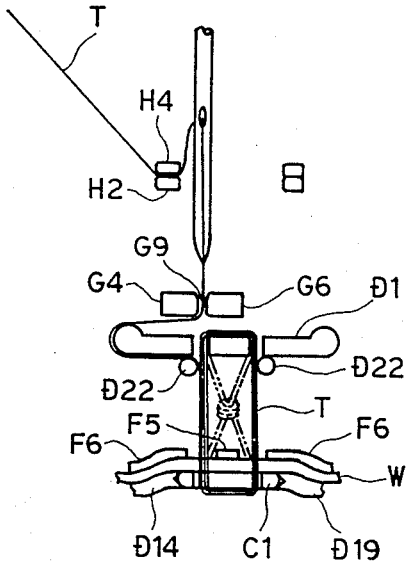
FIG. 9 shows the relative positions of a thread and a button when button-neck-wrapping is ready to start.

The center presser (F5), pictured in FIG. 9, presses the center portion of the stay button C1, and a workpiece (W). The outer presser (F6) presses the outer portion of the button (C1) and the workpiece (W). Symbol (F7) pictured in FIG. 4, denotes a cylinder which is rotatably sustained to the supportor (F1) by a pin (F8). A rod (F9) of the cylinder (F7) fixes a bifurcated body (F10) which rotatably clamps a projection (F11) from the mover (F2) with a pin (F12). When the cylinder (F7) expands, the mover (F2) moves leftwardly and simultaneously descends such that the center presser (F5) and the outer presser (F6) presses the workpiece W and the stay button (C1) as shown in FIG. 9.

Figure 8:
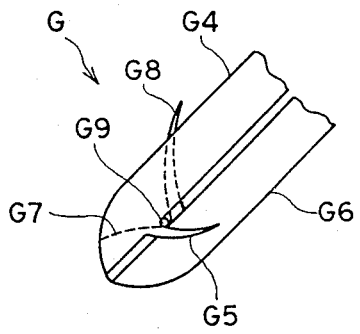
FIG. 8 is a partial plan view drawing of a thread clamping device H.

A thread guiding device (G) is pictured in FIG. 4. A well-known air chuck (G1) is comprised of two arms (G2) and (G3) similar to pliers. At the end of the arm (G2), a first thread guide (G4) is fixed with a finger (G5) at its tip portion. At the end of the arm (G3), a second thread guide G6 is fixed with fingers (G7) and (G8). When the air chuck (G1) acts, two arms G4, G8 are close as shown in FIG. 8, and these three fingers G5, G7 and (G8) form a thread guiding hole (G9). This thread guiding hole (9) is positioned just under the needle N as shown in FIG. 9.

A thread holding device (H) is shown in FIG. 4. A lower thread holding body (H1) with a lower clamper (H2) at its tip end is vertically aligned with an upper thread holding body (H3) with an upper clamper H4. As shown in FIG. 2, an air cylinder (H5) is affixed by its upper portion to the frame 2. A rod (H6) of the cylinder (H5) is connected to the center portion of the upper holding body (H3). When the cylinder (H5) is not acting, the upper clamper (H4) separates from the lower clamper (H2). Referring to FIG. 2, when the cylinder (H5) expands, and the upper thread holding body (H3) is down turned, the upper clamper (H4) presses the lower clamper (H2) and the thread T is sandwiched between these clampers (H4) and (H2). The clamping force created between these two upper and lower clampers is not sufficiently strong to deter the thread from passing through these clampers.

FIG. 10 illustrates the stitching and neckwrapping of buttons as performed by the present invention. The stay button (C1) is set onto the stay button holder (A15), and the surface button (D1) is set onto the surface button holder (A16). Cylinder A5 (shown in FIG. 4) expands, so the block body (A7) descends and simultaneously rotates counter clockwise in FIG. 4 such that the block body positions as shown in dotted line in FIG. 10A. the stay button (C1) is then placed between curved jaws (C5) and (C7), and the surface button D1 is placed between curved jaws (D14) and (D19). The cylinder (C12) (shown in FIG. 7) expands such that the stay button is clamped by curved jaws (C5), (C7). The cylinder (D16) (shown in FIG. 6) expands such that the surface button (D1) is clamped by curved jaws (D14) and (D19). The cylinder (A5) (shown in FIG. 4) draws back to the block body (A7) and resumes its original position.

Figure 10A:
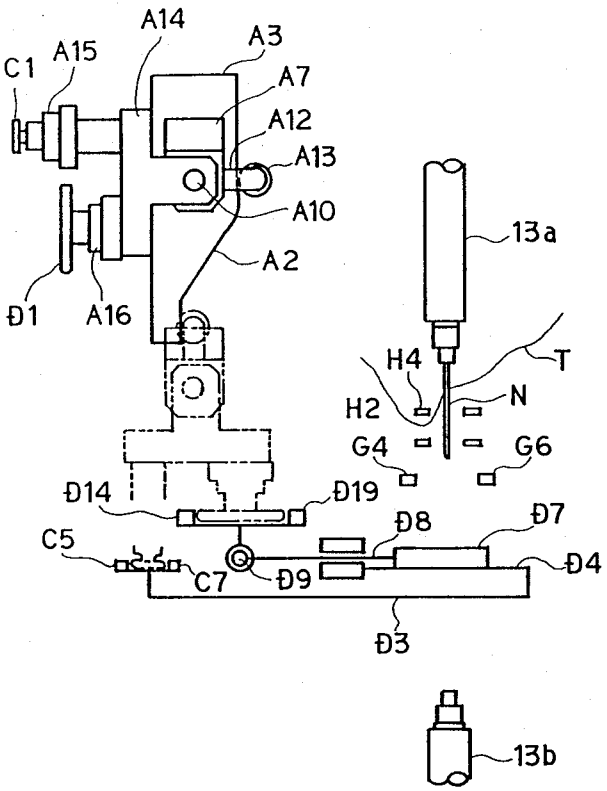
FIG. 10A to FIG. 10M are explanatory, step by step, of how buttons are sewn and button-neck-wrapped.
Figure 10B:
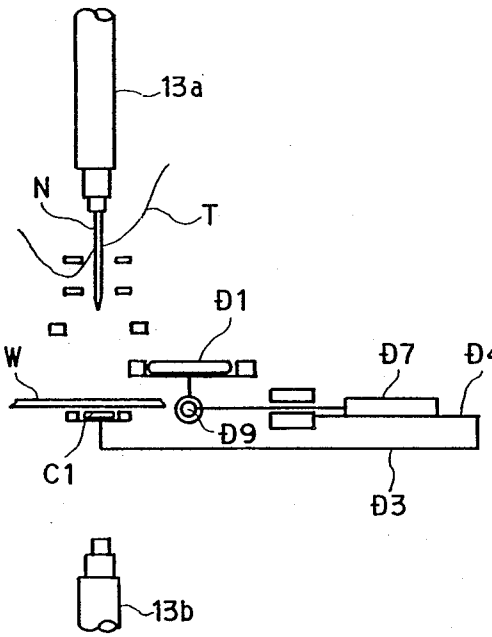
Figure 10C:
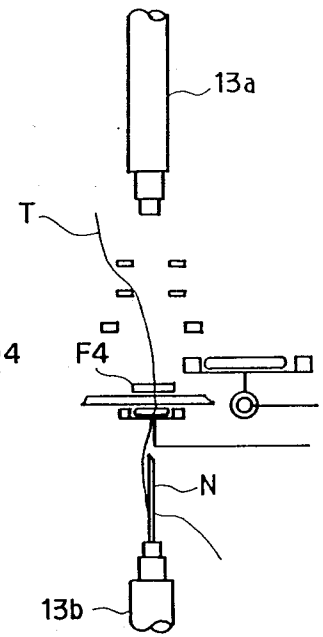
Figure 10D:
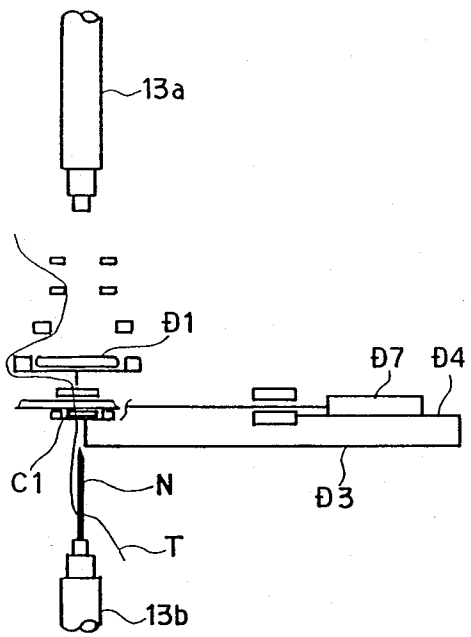
Figure 10E:
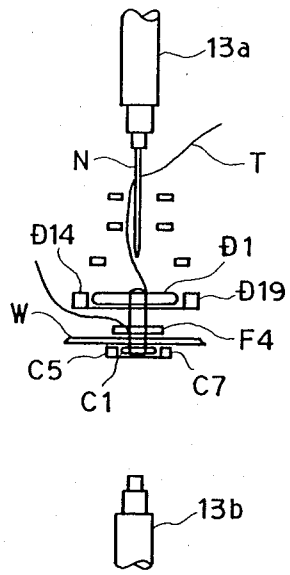
Figure 10F:
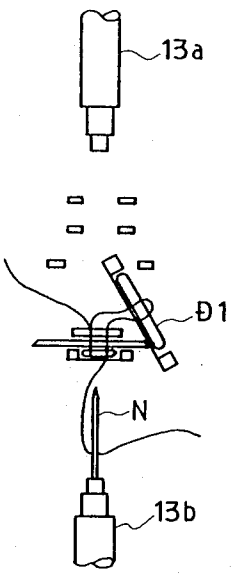
Figure 10G:
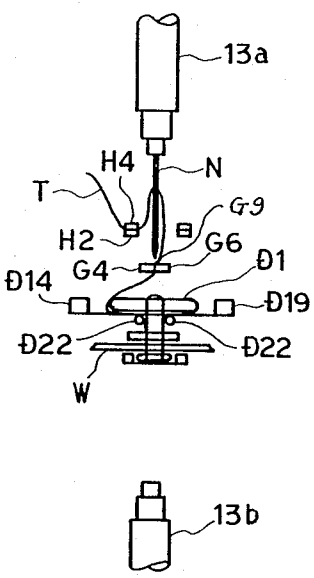
Figure 10K:
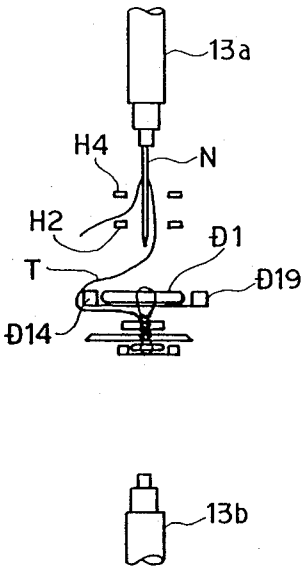
Figure 10J:
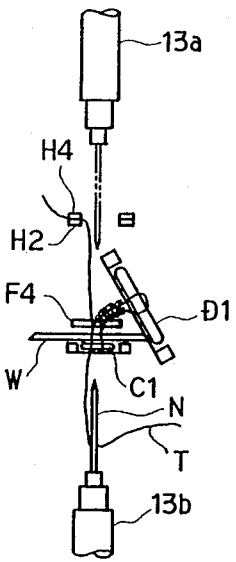
Figure 10I:
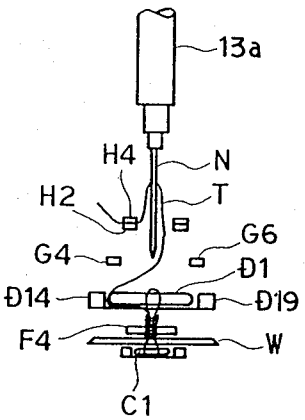
Figure 10H:
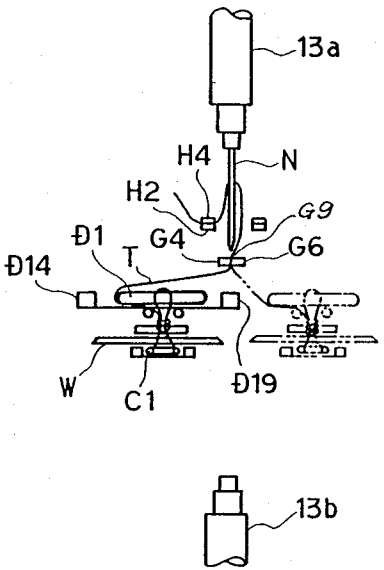
Figure 10M:
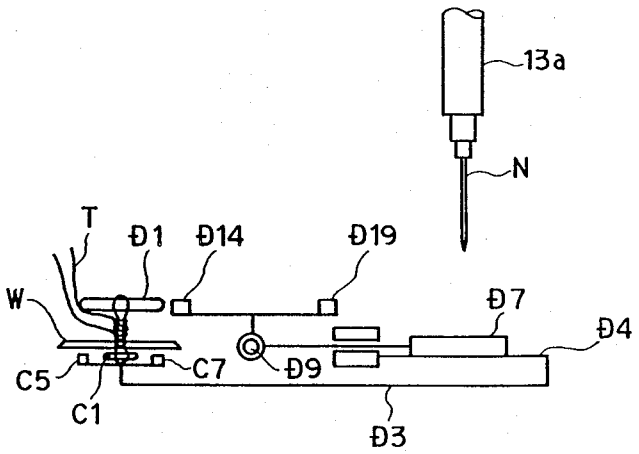
Figure 10L:
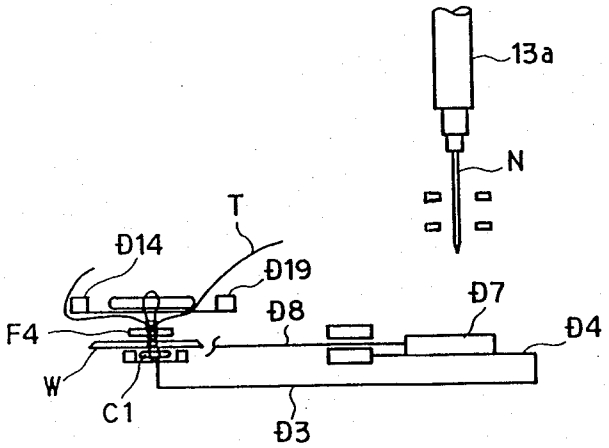
Figure 11A:
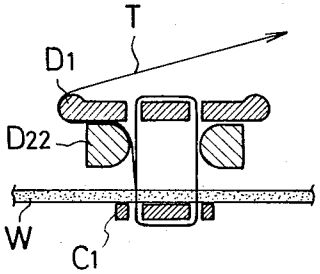
FIG. 11A to FIG. 11D are explanatory, step by step, of how button-neck-wrapping is formed.
Figure 11B:
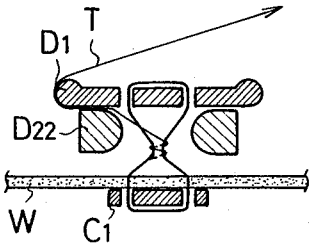
Figure 11C:
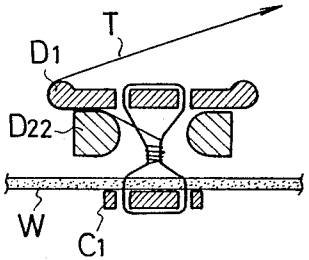
Figure 11D:
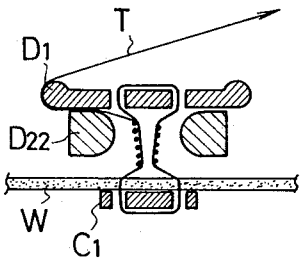

The pulse motor B5 (shown in FIG. 4) rotates for predetermined rotations (as shown in FIG. 10B), and the stay button (C1) is positioned just under the needle N. The workpiece W is then placed on the stay button C1 and, as shown in FIG. 10C, the workpiece W is set under the presser foot (F4) such that the stitching point coincides with the stay button C1. The cylinder (F7) (shown in FIG. 3, FIG. 4) expands, so the presser foot (F4) presses the workpiece W. The sewing machine then makes one half rotation; the needle N passes through the button hole and then is received by the lower needle-bar (13*b*). The lower looper 4*b* (FIG. 2) then rotates and pulls the thread T downwards and the sewing machine stops. The cylinder (D7) (FIG. 4) expands, so the slider (D6) shown in FIG. 10D moves leftwardly, and resultantly the surface button (D1) clamped by the curved jaws D14 and D19 are positioned just above the stay button (C1). As shown in FIG. 10E, once the button holes of the button D1 and the stay button (C1) are coincided, the sewing machines starts again. The drive shaft (6) as shown in FIG. 2, conducts the predetermined rotations. Pulse motors (B5) and (B10) (see FIG. 4) rotate alternately and reversibly in association with the drive shaft (6) such that the needle N passes through the workpiece and through the button holes of both stay and surface buttons. The needle (N) then travels between the upper-needle-bar (13*a*) and the lower-needle-bar (13*b*), sewing the stay button (C1) and the surface button (D1) to the workpiece. The sewing machine then stops. (FIG. 10F) Then the cylinder (E6) (FIG. 4) is withdrawn and the rod (E7) moves rightwards, causing rack (E5) to rotate gear (E1) clockwise. This clockwise rotation of gear (E1) rotates support plate D11 clockwise, and turns surface button (D1) placing the surface button (D1) aside from the needle's pass-way. The one rotation as made by the sewing machine and the drive shaft (6), after which needle (N) passes through the workpiece (W) and the button hole of the stay button (C1), is received by the lower-needle-bar 13*b*, and then passes through the button hole of the stay button (C1). After penetrating the workpiece (W) the needle is received by the upper-needle-bar 13*a* and the sewing machine stops. See FIGS. 10F, and G. (FIG. 10G)

Cylinder E6 (FIG. 4) expands, so the surface button D1 is positioned horizontally. The air chuck (G1) (FIG. 4) operates the first thread guide (G4) and the second thread guide G6 so that they form a thread guide hole (G9) directly under the needle (N), as shown in FIG. 8 and FIG. 9. Cylinder (H5) (FIG. 2) expands, so the upper clamper (H4) descends and presses the thread T against the lower clamper (H2). Cylinder D24 (FIG. 4) expands, so the bifurcated-button-holder D22 projects to just under the surface button (D1) as shown in FIG. 6. Cylinder (D16) then expands, releasing the surface button (D1) from curved jaws (D14) and (D19).

The thread (T) performs button-neck-wrapping when two pulse motors (B5) and (B10) carry the surface button (D1), the workpiece W, and then stay button (C1) through several circular motions, keeping the needle entry as the center. At that point, the thread (T) is firmly but slidably sandwiched between the lower clamper (H2) and the upper clamper (H4) to create tension on the threat T for the button-neck-wrapping. (FIG. 101) Once the button-neck-wrapping is completed the sewing machine stops. The cylinder (D16) (FIG. 5) withdraws, and curved jaws (D14) and (D19) clamp the surface button (D1) again; air chuck (G1) (FIG. 4) unloads, opening the first thread guide (G4) and the second thread guide (G6). The cylinder (D24) (FIG. 6) withdraws, moving the bifurcated-button-holder (D22) rightwards to resume its original position as shown in FIG. 5. Cylinder E6 (FIG. 4) withdraws turning the surface button D1 clockwise to be positioned aside from the needle's pass-way. The sewing machine then starts again to perform back tacking whereby the needle (N) travels between the upper-needle-bar 13*a* and the lower-needle-bar 13*b*. The sewing machine stops when the needle is received in the upper-needle-bar 13*a*. (see FIG. 10K). The cylinder (E6) (FIG. 4) and positions the surface button D1 horizontally again. The cylinder (H5) (FIG. 2) withdraws; upper clamper (H4) ascends so that thread T is pressed between the upper clamper (H4). Lower clamper H2 is released. The pulse motor (B5) (FIG. 4) moves the X-mover B9 to resume its original position. The thread T unthreads from the needle N and the sewn button and the workpiece move in direction of X and pull the thread T. The cylinder D16 (FIG. 3) expands and the surface button D1 is released from curved jaws (D14) and (D19). While cylinder (C12) (FIG. 7) expands, and the stay button C1 is unclamped by jaws (C5) and (C7), the cylinder (F7) (FIG. 4) withdraws, and releases the workpiece (W) from the presser foot (F4) and the cylinder (D7) withdraws, so that the curved jaws (D14) and (D19) release from the surface button D1.

The operator then cuts the thread T coming from the supply source and holds the surface button, the workpiece, and the stay button together and with a horizontal movement, the workpiece is taken out from the sewing machine.

Rather than practicing the invention by sewing a stay button and a surface button onto a workpiece and then performing button-neck-wrapping, the stay button may be omitted so that the surface button is sewn directly to the workpiece, applying the same method and steps for button-neck-wrapping.

As many different embodiments of the invention may be made without departing from the spirit and scope thereof, and the invention is not limited to any specific embodiment except as defined in the appended claims.

What is claimed:

1. In a button sewing machine having a driving device to traverse a needle provided with the predetermined length of thread for sewing attached thereto comprising an upper-needle-bar and a lower-needle-bar which are arranged to conduct relative up-down motion, and a moving device which moves a workpiece with a button attached thereto in an X–Y direction, a method of button-neck-wrapping after sewing both a stay button, and a surface button comprising the steps of:

(a) turning a surface button to be positioned aside from needle's passage-way so that the needle may penetrate upward into a work piece and be received into an upper-needle-bar, (b) guiding a thread into a guide formed under a needle, and pressing the thread between clampers to stretch the thread when pulled, and releasing surface button chucking, and (c) driving a X–Y mover to perform circular motion horizontally to conduct button-neck-wrapping.

* * * * *